US007959447B2

(12) United States Patent
Lim

(10) Patent No.: US 7,959,447 B2
(45) Date of Patent: Jun. 14, 2011

(54) ELECTRICAL CONNECTOR WITH SOLDER TABS

(75) Inventor: Chin Hua Lim, Singapore (SG)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 12/740,748

(22) PCT Filed: Oct. 27, 2008

(86) PCT No.: PCT/US2008/081361

§ 371 (c)(1), (2), (4) Date: Apr. 30, 2010

(87) PCT Pub. No.: WO2009/061631

PCT Pub. Date: May 14, 2009

(65) Prior Publication Data

US 2010/0297888 A1 Nov. 25, 2010

(30) Foreign Application Priority Data

Nov. 7, 2007 (SG) ..... 200717558-1

(51) Int. Cl.
*H01R 12/00* (2006.01)

(52) U.S. Cl. ..... 439/79

(58) Field of Classification Search ..... 439/79, 439/80, 83, 638, 76.1, 541.5
See application file for complete search history.

(56) References Cited

U.S. PATENT DOCUMENTS

| | | | |
|---|---|---|---|
| 4,878,858 | A | 11/1989 | Dechelette |
| 5,746,662 | A | 5/1998 | Consoli |
| 5,785,549 | A | 7/1998 | Takayasu |
| 5,842,883 | A | 12/1998 | Igarashi |
| 5,863,210 | A | 1/1999 | Reisinger |
| 5,904,586 | A | 5/1999 | Takayasu |
| 6,086,429 | A | 7/2000 | Wu |
| 6,203,345 | B1 | 3/2001 | Roque |

(Continued)

FOREIGN PATENT DOCUMENTS

| | | |
|---|---|---|
| DE | 19815016 | 9/1998 |

OTHER PUBLICATIONS

Search Report for International Application No. PCT/US2008/081355, 4 pgs.

Search Report for International Application No. PCT/US2008/081361, 4 pgs.

Search Report for Singapore Patent Application No. 2007/17559-9, 4 pgs.

(Continued)

*Primary Examiner* — Jean F Duverne

(74) *Attorney, Agent, or Firm* — Melanie G. Gover; Dean M. Harts; Johannes P. M. Kusters

(57) ABSTRACT

A connector comprising an insulative housing that has a top, a bottom, a first side, a second side, all four sides connected to form a mating face and a board-mounting end; a plurality of terminals supported in the housing and terminating at the board-mounting end wherein each terminal further comprises a contact portion configured to establish electrical contact with a complementary mating connector, a solder tail that extends out of the housing at the board-mounting end, a body portion that is disposed intermediate the contact portion and the solder tail and which interconnect them together; a plurality of solder tabs engaged with the housing; and a plurality of engagement portions coupled to the housing to confine the solder tabs to a predetermined position with respect to the housing.

13 Claims, 5 Drawing Sheets

U.S. PATENT DOCUMENTS

| | | | | |
|---|---|---|---|---|
| 6,227,877 | B1 | 5/2001 | Wu | |
| 6,227,907 | B1 | 5/2001 | Wu | |
| 6,402,554 | B1 | 6/2002 | Yeh | |
| 6,726,499 | B1 | 4/2004 | Yu | |
| 7,018,238 | B1 | 3/2006 | Zhi-xuan | |
| 7,086,895 | B1 * | 8/2006 | Ting | 439/541.5 |
| 7,238,048 | B2 * | 7/2007 | Olson et al. | 439/607.28 |
| 7,517,232 | B2 * | 4/2009 | Yuan et al. | 439/79 |
| 7,588,445 | B2 * | 9/2009 | He et al. | 439/79 |
| 7,591,683 | B2 * | 9/2009 | Zhang et al. | 439/638 |
| 7,686,628 | B2 * | 3/2010 | Lino et al. | 439/108 |
| 2004/0166711 | A1 | 8/2004 | Uchida | |
| 2006/0009080 | A1 | 1/2006 | Regnier | |
| 2006/0014438 | A1 | 1/2006 | Reginer | |
| 2006/0040556 | A1 | 2/2006 | Neer | |
| 2010/0248549 | A1 | 9/2010 | Lim | |

OTHER PUBLICATIONS

Search Report for Singapore Patent Application No. 200717558-1, 3 pgs.

Written Opinion for International Application No. PCT/US2008/081355, 7 pgs.

Written Opinion for International Application No. PCT/US2008/081361, 7 pgs.

Written Opinion for Singapore Patent Application No. 200717558-1, 5 pgs.

Written Opinion-Second for Singapore Patent Application No. 2007/17558-1, 7 pgs.

* cited by examiner

ELECTRICAL CONNECTOR WITH SOLDER TABS

CROSS REFERENCE TO RELATED APPLICATIONS

This application is a national stage filing under 35 U.S.C. 371 of PCT/US2008/081361, filed Oct. 27, 2008, which claims priority to Singapore Application No. 200717558-1, filed Nov. 7, 2007, the disclosure of which are incorporated by reference in their entirety herein.

TECHNICAL FIELD

The present invention relates to the art of connectors and, particularly to an electrical connector adapted for mounting on a printed circuit board.

BACKGROUND

It is known that a printed circuit board (PCB) connector provides a connectable interface between a PCB and another device with a complementary mating connector. A PCB connector may be mounted on a PCB in many ways; directly soldering the PCB connector to a copper-coated pad on a surface of the PCB (often referred to as surface mounting) is one of them.

A surface mount connector (usually a receptacle) typically include a housing with a mating face for mating with a complementary connector (usually a plug) and a board-mounting end from which a plurality of terminals exit the housing for termination to circuit traces on the PCB. The surface mount receptacle may further include a plurality of mounting posts at the base of the housing for the purpose of aiding the alignment of the surface mount receptacle to the PCB during mounting.

The terminals normally include mating portions for mating with the terminals of the complementary plug connector and tail portions (often known as 'solder tails') projecting from the housing for interconnection, as by soldering, to circuit traces on the PCB or in holes in the PCB into which the tails are inserted. The solder tails are typically arranged in a single row or coplanar rows for automated connection to the conductive pads on the PCB.

With the miniaturisation of electronic equipment, small-sized surface mount receptacles with very fine solder tails have been developed. This is because the footprint allocated for each internal component is reduced to accommodate the limited internal space within the electronic equipment. U.S. Publ. No. 2006/0009080 and U.S. Publ No. 2006/0014438 disclose one such surface mount receptacle. Besides the mounting posts on the surface mount receptacle which are used for connector alignment with the PCB, the solder tails when soldered to the PCB often become the only means of securing the surface mount receptacle onto the PCB.

It is a common practice to connect cables to a PCB by terminating the cables to a plug connector (often jointly referred to as cable assembly) and then mating the plug connector to a surface mount receptacle on the PCB. A known problem with connecting a cable assembly to a PCB surface mount receptacle is the tendency for the cable's weight and movement to loosen the points of attachment of the surface mount receptacle to the PCB, thereby breaking signal pathways and causing the connection to the PCB to fail.

Sometimes, in an attempt to minimise the above problem, a large guide frame is used and is mounted to the PCB. However, such guide frames are large and take up valuable space on the PCB that could be used for additional circuits or terminations. In addition, in small, confined spaces as in a miniaturised electronic equipment, it is difficult to provide additional anchorage points for the guide frames without increasing the footprint of the surface mount receptacle.

The present invention is directed at solving the above problems by providing an improved structure for anchoring and holding a connector of the character described to a PCB.

SUMMARY

It would be desirable to provide a connector with an improved structure that can secure the connector to a printed circuit board and prevent the connector from lifting off due to the cable assembly's weight and movement.

In accordance with one embodiment of the present invention, there is provided an electrical connector, comprising:

an insulative housing that has a top, a bottom, a first side, a second side, all four sides connected to form a mating face and a board-mounting end;

a plurality of terminals supported in the housing and terminating at the board-mounting end wherein each terminal further comprises a contact portion configured to establish electrical contact with a complementary mating connector, a solder tail that extends out of the housing at the board-mounting end, a body portion that is disposed intermediate the contact portion and the solder tail and which interconnect them together;

a plurality of solder tabs engaged with the housing; and a plurality of engagement portions coupled to the housing to confine the solder tabs to a predetermined position with respect to the housing.

In accordance with another embodiment of the present invention, there is provided an electrical connector configured to be mounted on a printed circuit board comprising:

an insulative housing that has a top, a bottom, a first side, a second side, all four sides connected to form a mating face and a board-mounting end wherein at the mating face, there is at least one mating slot extending into the housing;

a plurality of terminals supported in the housing and terminating at the board-mounting end wherein the terminals are grouped into a first set and a second set and each terminal in the first set and the second set further comprises a contact portion that extends into the mating slot, a solder tail that extends out of the housing at the board-mounting end, a body portion that is disposed intermediate the contact portion and the solder tail and which interconnect them together;

a plurality of solder tabs engaged with the housing; and a plurality of engagement portions coupled to the housing to confine the solder tabs to a predetermined position with respect to the housing.

BRIEF DESCRIPTION OF THE DRAWINGS

An exemplary form of the present invention will now be described with reference to the accompanying drawings in which.

While the above-identified figures set forth several embodiments of the invention, other embodiments are also contemplated, as noted in the detailed description. In all cases, this disclosure presents aspects of the invention by way of representation and not limitation. It should be understood that numerous other modifications and embodiments can be devised by those skilled in the art, which fall within the scope and spirit of the principles of the invention. The figures may not be drawn to scale. Like reference numbers have been used throughout the figures to denote like parts.

DETAILED DESCRIPTION

Figure 1A:
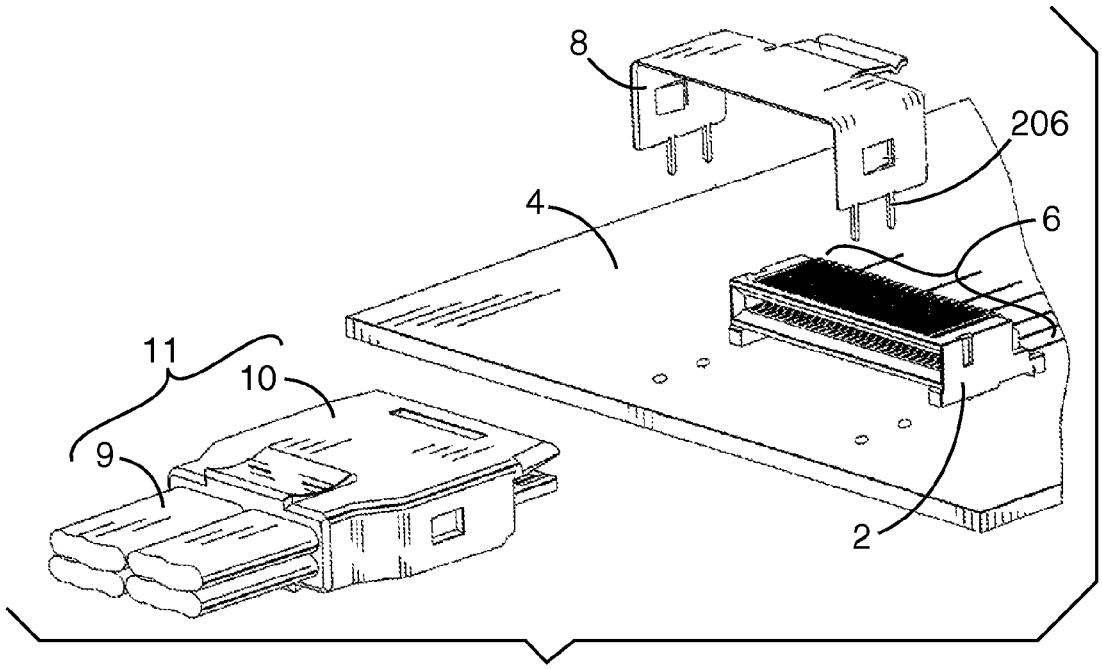
Fig. 1A PRIOR ART
FIG. 1A shows a prior art cable assembly with a plug connector aligned to mate with a receptacle connector surface mounted on a printed circuit board and a guide member in position to be soldered on the printed circuit board.
Figure 1B:
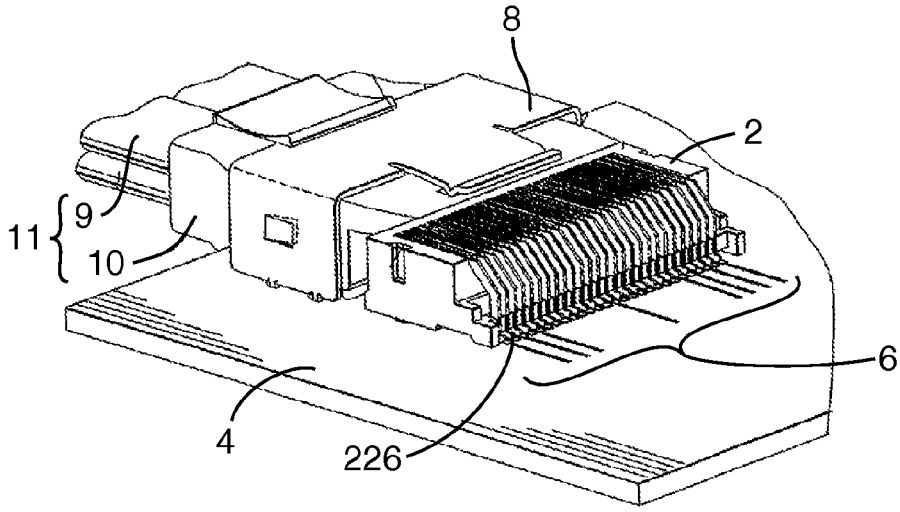
Fig. 1B PRIOR ART
FIG. 1B shows the plug connector of the cable assembly of FIG. 1A engaged with the receptacle connector surface mounted on the printed circuit board and the guide member in place between the plug connector and the receptacle connector.

FIGS. 1A and 1B show a prior art receptacle connector 2 soldered into place on a printed circuit board (PCB) 4 via a plurality of solder tails 226. Electrical signals between the conductive traces 6 of the PCB 4 and a cable assembly 11 can be exchanged by terminating the cables 9 at a plug connector 10 and mating the plug connector 10 with the receptacle connector 2. The plug connector 10 is at least partially guided into place by way of a guide member 8 associated with the receptacle connector 2, and this guide member 8 is mounted via a plurality of mounting posts 206 to the PCB 4 in a location that is forward of and spaced apart from the receptacle connector 2.

For a small receptacle connector 2, the solder tails 226 by which the receptacle connector 2 are soldered onto the PCB 4 are very fine. Other than a plurality of mounting posts on the connector housing, the points of attachment where the solder tails 226 are soldered onto the PCB 4 are often the only means in which the receptacle connector 2 is anchored and secured on the PCB 4. Due to the great disparity between the weight of the cable assembly 11 and the amount of solder contact at the points of attachment, any movement of the cable assembly 11 can add great mechanical stress to the solder tails 226 and loosen the points of attachment of the solder tails 226 causing the receptacle connector 2 to lift off the PCB 4, thereby breaking signal pathways and causing the connection to the PCB 4 to fail. The present invention is directed at resolving the problem of the receptacle connector 2 lifting off the PCB 4 and thus, minimising the likelihood of premature PCB connection failure.

Figure 2A:
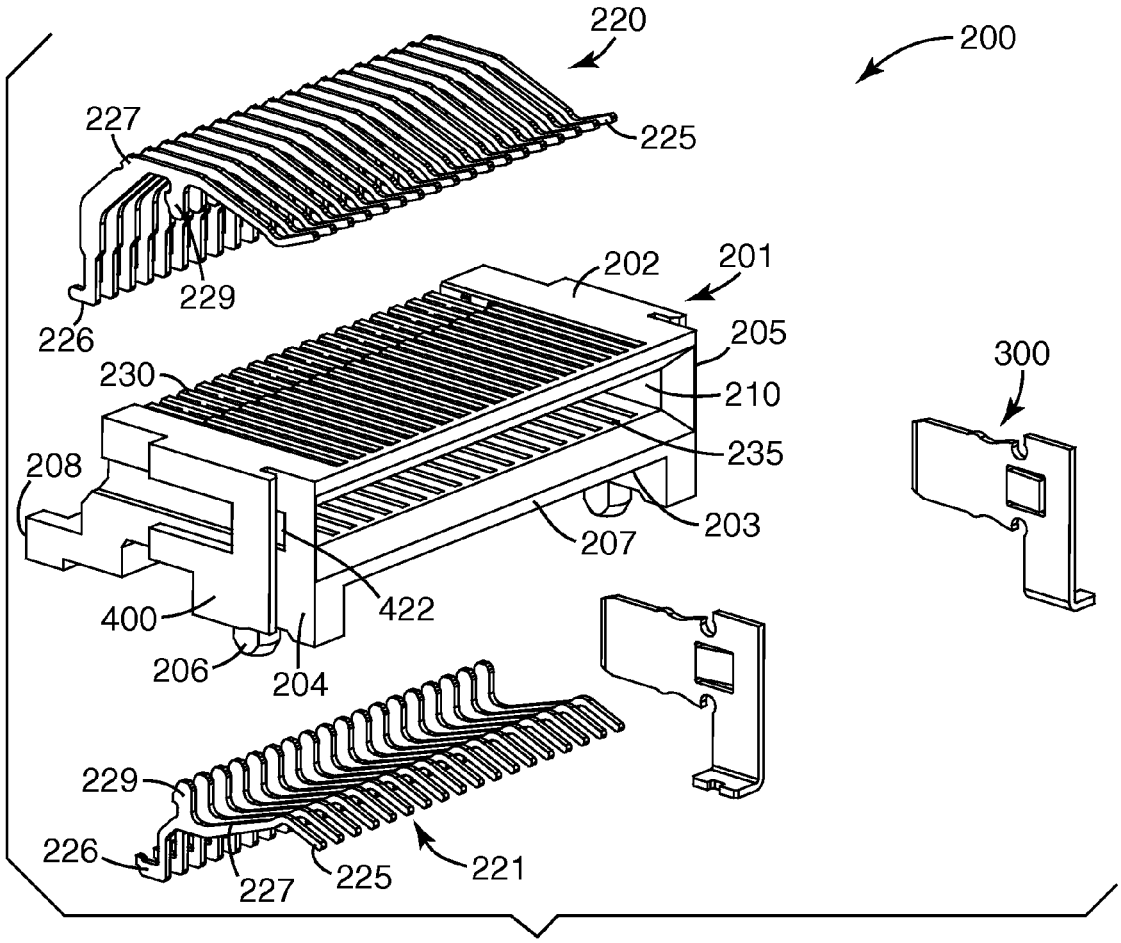
FIG. 2A is an exploded perspective view of an exemplary connector of the present invention.
Figure 2B:
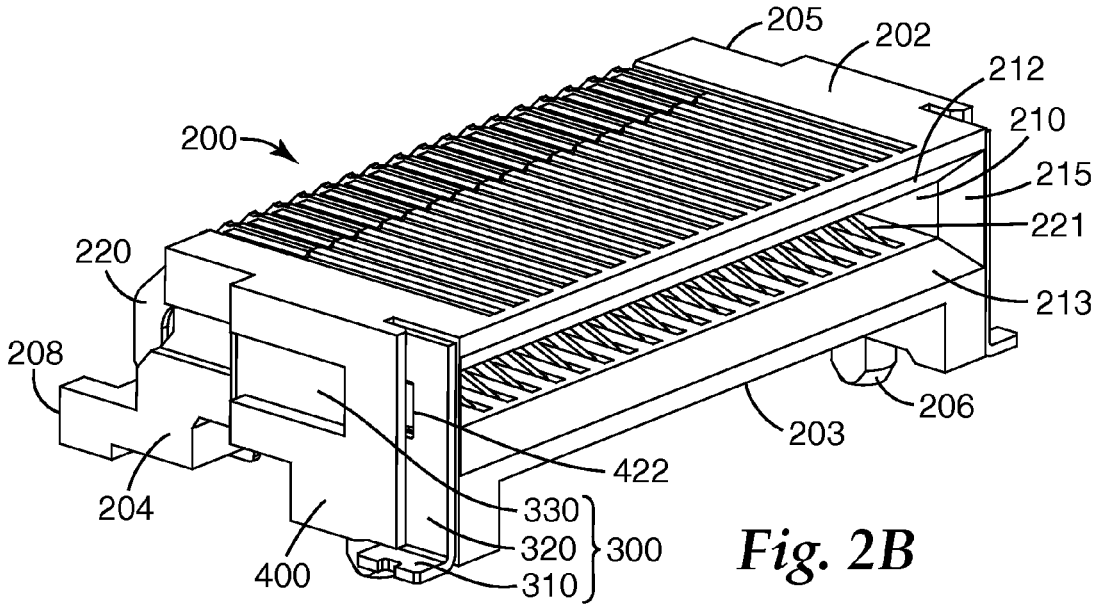
FIG. 2B is a perspective view of the assembled exemplary connector of FIG. 2A.
Figure 3:
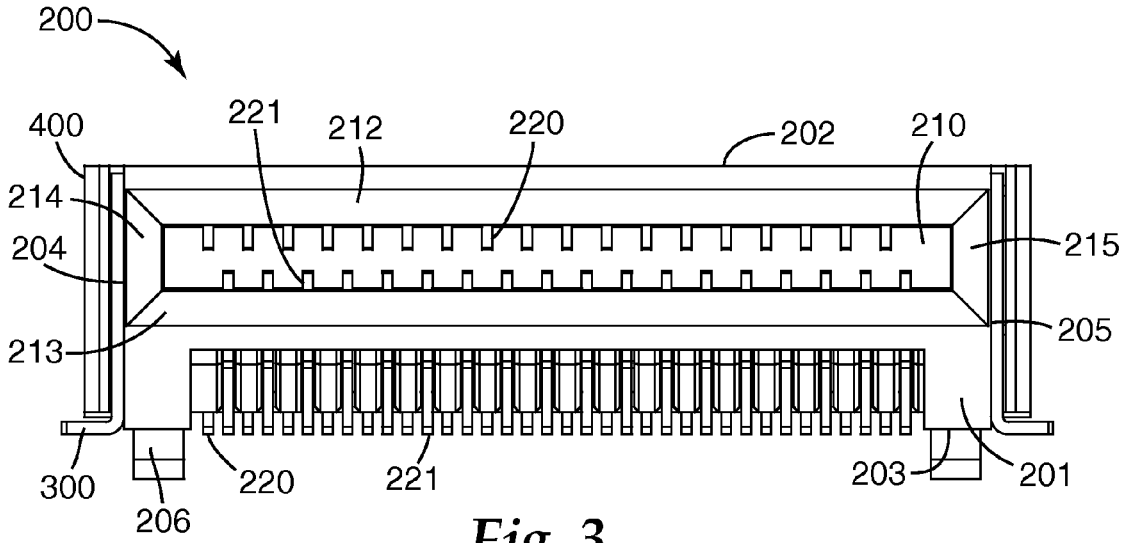
FIG. 3 is a front view of the exemplary connector of FIG. 2B looking towards a mating face of the connector.
Figure 4:
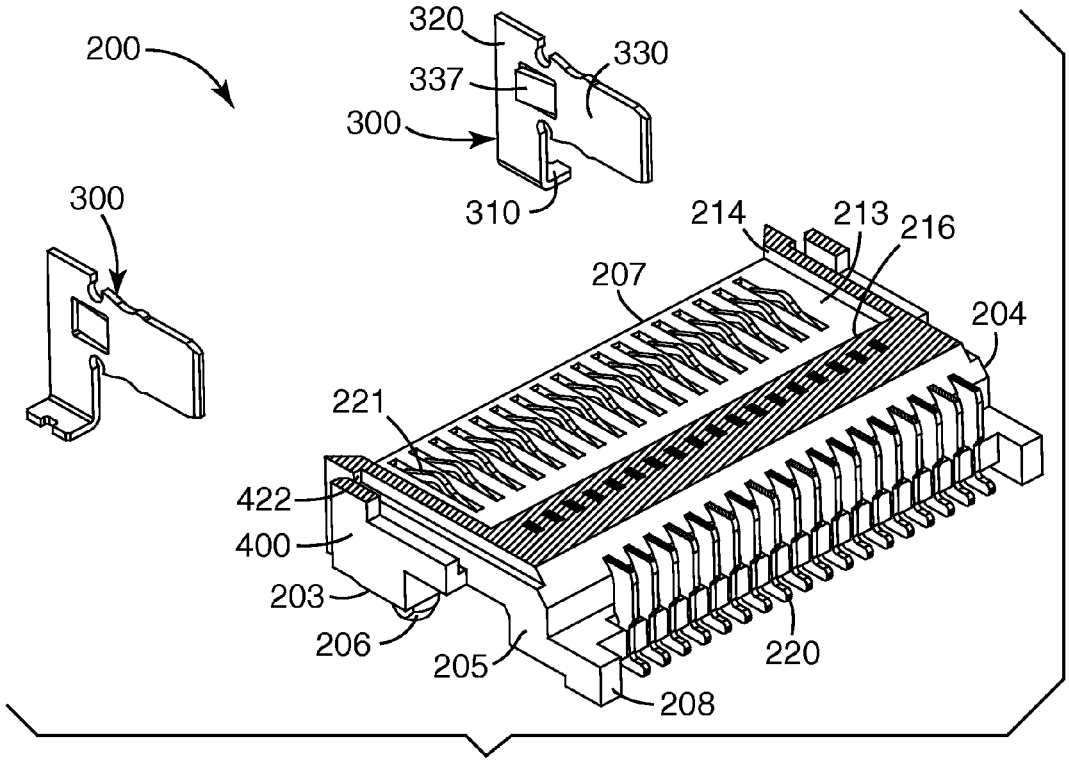
FIG. 4 is a perspective view of a horizontal cross-section of the exemplary connector of FIG. 2B with a plurality of solder tabs aligned in position to be engaged with the connector.

Referring to FIGS. 2, 3 and 4, an exemplary connector 200 in accordance with the present invention comprises an insulative housing 201 that has a top 202, a bottom 203, a first side 204, a second side 205, all four sides connected to form a mating face 207 and a board-mounting end 208; a first set and a second set of terminals 220, 221 supported in the housing 201 and terminating at the board-mounting end 208; a plurality of solder tabs 300 engaged with the housing 201 and a plurality of engagement portions 400 coupled to the housing 201 to confine the solder tabs 300 to a predetermined position with respect to the housing 201. The bottom 203 of the housing 201 may include a plurality of mounting posts 206 for the purpose of positioning the connector 200 on the PCB 4. Preferably at the mating face 207, there is a mating slot 210 that receives a complementary plug connector 10 of a cable assembly 11. The mating slot 210 extends into the interior of the housing 201 and is bounded by a top wall 212, a bottom wall 213, two side walls 214, 215 and a rear wall 216.

It should be noted that the arrangement of the two connectors in this description (i.e. a receptacle connector on the PCB and a plug connector at an end of a cable assembly) has been presented for the purpose of illustration and description. It is not intended to be exhaustive or to limit the invention to the precise forms disclosed, since many modifications or variations (e.g. a plug connector on the PCB and a receptacle connector at an end of a cable assembly) thereof are possible in light of this teaching. All such modifications and variations are within the scope of the invention.

The first set of terminals 220 and the second set of terminals 221 extend into the mating slot 210 and provide an electrical transmission path from the cable assembly 11 to the PCB 4. The first set of terminals 220 is similar to the second set of terminals 221 in that each terminal in the two sets include a contact portion 225 that extends into the mating slot 210 and a solder tail 226 that extends out of the housing 201 for attachment to the PCB 4 on which the connector 200 is to be mounted. Each terminal also includes a body portion 227 that is disposed intermediate the contact portion 225 and the solder tail 226 and which interconnect them together. Each terminal may further comprise a retention portion 229 which primarily serve to retain the terminal in place within the housing 201.

The first set of terminals 220 are inserted into a plurality of top slots 230 that are formed in the top wall 212 of the housing 201 which include openings that communicate with the mating slot 210 and are positioned so that the contact portions 225 of the first set of terminals 220 may at least partially extend into the mating slot 210. The second set of terminals 221 are inserted into a plurality of bottom slots 235 that are formed in the bottom wall 213 of the housing 201 which include openings that communicate with the mating slot 210 and are positioned so that the contact portions 225 of the second set of terminals 221 may at least partially extend into the mating slot 210.

Figure 5A:
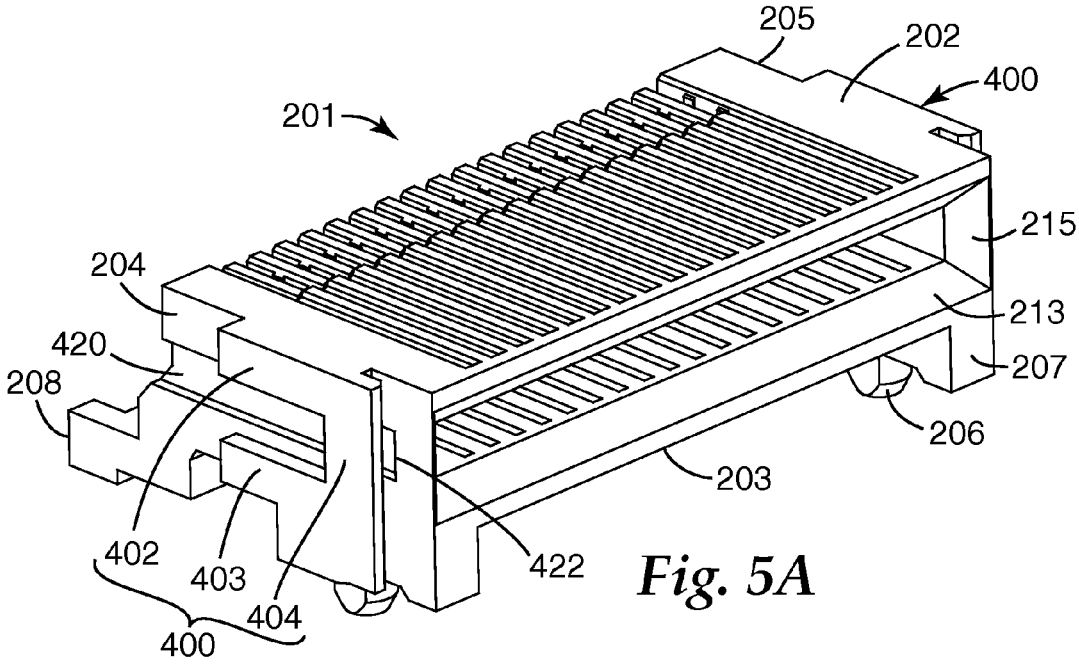
FIGS. 5A and 5B are perspective views and FIG. 5C is a side view of the housing and engagement portion of the exemplary connector of FIG. 2B.
Figure 5B:
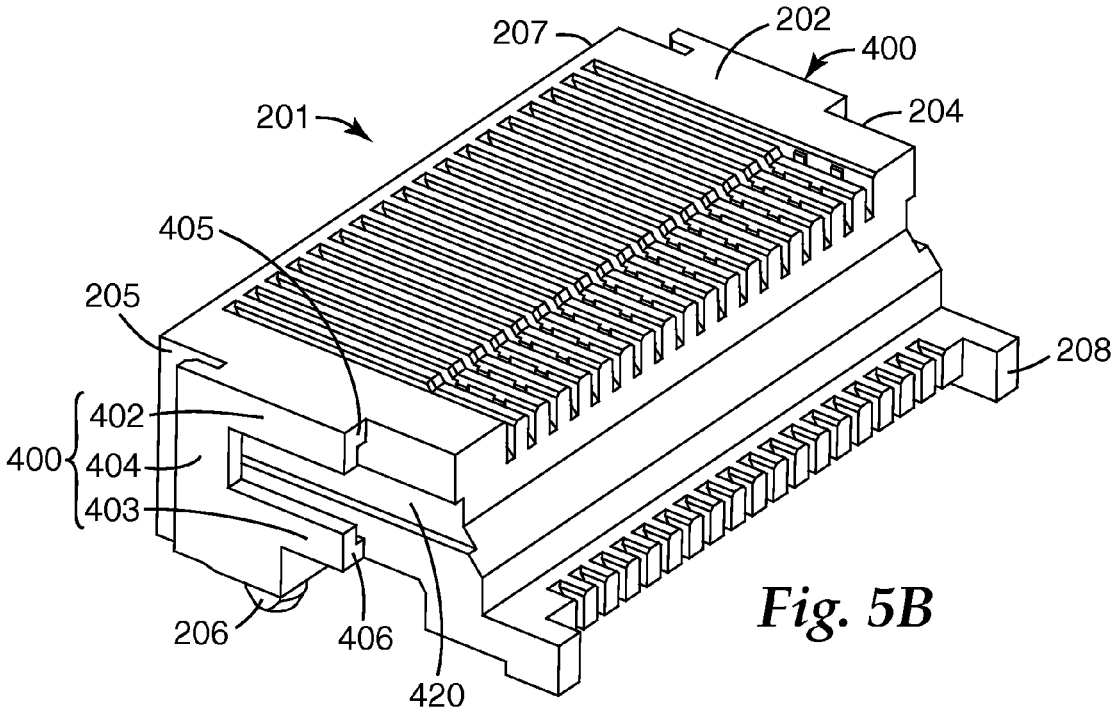
Figure 5C:
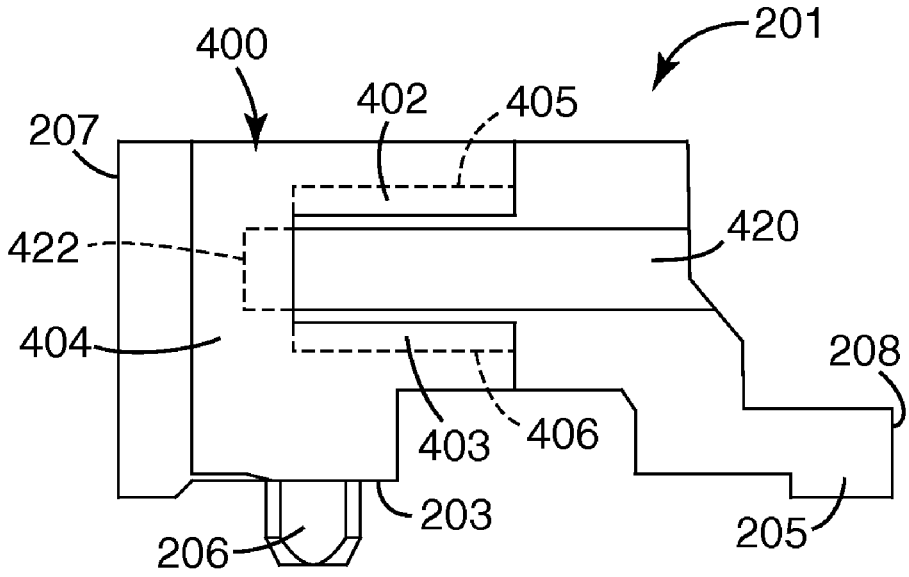

Referring to FIGS. 5A, 5B and 5C, in one embodiment of the present invention there is at least one engagement portion 400 coupled to at least one side of the housing 201 preferably with a general 'C-shape' creating a sleeve with the housing 201 comprising a top portion 402, a vertical portion 404 and a bottom portion 403. Preferably, both the top portion 402 and bottom portion 403 have a step at the side contiguous to the side of the housing 201 thereby creating a insertion slot between the engagement portion 400 and the side of the housing 201 comprising a top ledge 405 and a bottom ledge 406.

Figure 6:
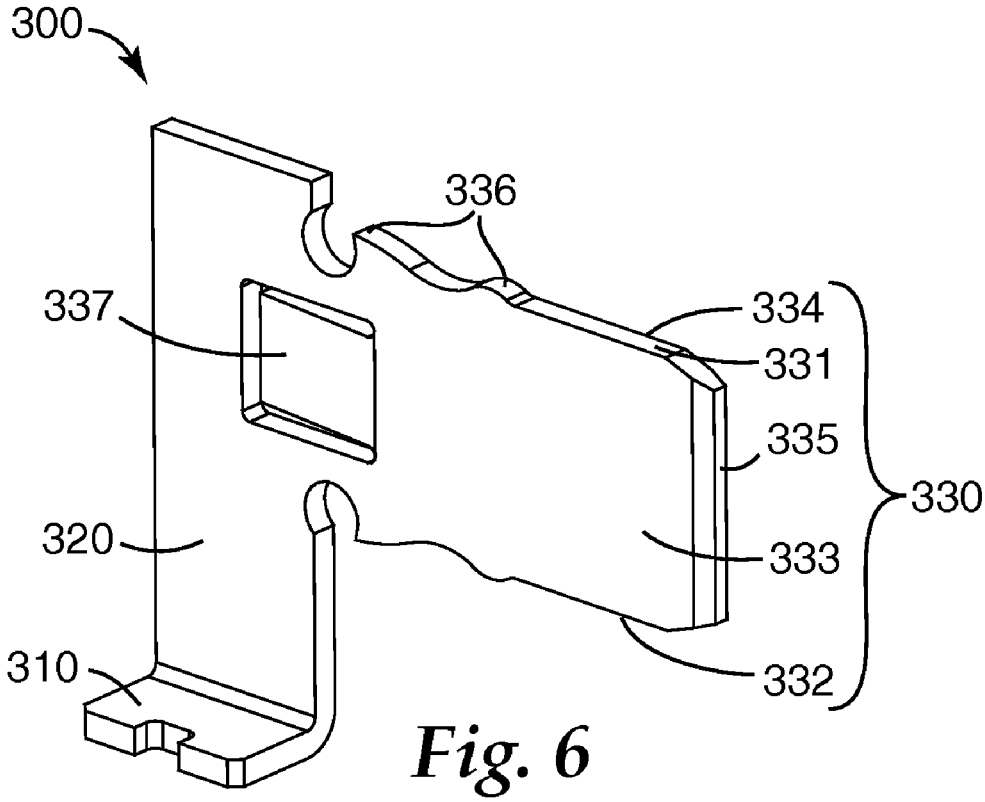
FIG. 6 is a perspective view of one embodiment of a solder tab which forms part of the exemplary connector of FIG. 2A.

Referring to FIG. 6, in one embodiment of the present invention, there is at least one solder tab 300 engaged with at least one side of the housing 201 wherein each solder tab 300 comprises a solder contact portion 310, an interconnect portion 330 and a structure support portion 320 bridging the solder contact portion 310 and the interconnect portion 330.

The solder contact portion 310 may be stamped as part of the structure support portion 320 and may either extend away from the side of the housing 201 or extend towards the side of the housing 201. The solder contact portion 310 when soldered to the PCB 4 provides additional points of attachment for the surface mount receptacle 200 thereby further securing the surface mount receptacle 200 to the PCB 4 and preventing the surface mount receptacle 200 from lifting off the PCB 4 due to the weight or movement of the cable assembly. Alternatively, the solder contact portion 310 may extend downwards towards the PCB 4 similar to the mounting post 206 and may either soldered or press-fitted into the PCB 4 for additional support.

In one embodiment of the present invention, the interconnect portion 330 comprises a first edge 331, a second edge 332, a first face 333, a second face 334 connected to form a distal end 335 and wherein the first edge 331, the second edge 332, the first face 333 and the second face 334 taper towards the distal end 335. Tapering the two edges 331, 332 and the two faces 333, 334 near the distal end 335 reduces the amount of force needed to insert the interconnect portion 330 in the direction from the mating face 207 to board-mounting end 208 into the insertion slot bounded by the top ledge 405 and the bottom ledge 406 between the engagement portion 400 and the side of the housing 201.

In one embodiment of the present invention, the interconnect portion 330 further comprises a plurality of indentations 336 along the first edge 331 and/or the second edge 332. Each indentation 336 may be sized, shaped, arranged and oriented similarly or differently. The characteristics and arrangement of each indentation 336 are designed to provide adequate frictional contact between the interconnect portion 330 of the solder tab 300 and the top ledge 405 and/or bottom ledge 406 of the engagement portion 400 once the interconnect portion 330 is fully inserted into the insertion slot bounded by the top ledge 405 and the bottom ledge 406 between the engagement portion 400 and the side of the housing 201. As parts of the indentations 336 penetrate into the top ledge 405 and/or bottom ledge 406, the indentations 336 become anchorage points securing the solder tab 300 to the connector 200 because the engagement portion 400 is coupled to the side of the housing 201.

In one embodiment of the present invention, the solder tab 300 further comprises a locking device 337 to prevent the accidental disengagement of the solder tab 300 from the connector 200. The locking device 337 may include, but is not limited to, a resilient side locking latch extending inwards from the first face 333 to the second face 334 of the interconnect portion 330. Preferably, the housing 201 include a hollow area 420 in the form of a recess in the side of the housing 201 contiguous to the engagement portion 400. The hollow area 420 may include, but is not limited to, a lengthwise slot in the housing 201 contiguous to the insertion slot bounded by the top ledge 405 and the bottom ledge 406 of the engagement portion 400. As the interconnect portion 330 of the solder tab 300 gets inserted into the insertion slot bounded by the top ledge 405 and the bottom ledge 406, the side locking latch is flexed outwards with respect to the side of the housing 201 until it passes a lead-in edge 422 of the hollow area 420 whereby the side locking latch then returns to its original position. In this case, the hollow area 420 acts as a "keyway" for the side locking latch such that in the event that a disengagement force is exerted in a direction reverse to the insertion direction, the lead-in edge 422 of the hollow area 420 will oppose the reverse movement of the side locking latch thereby preventing the solder tab 300 from decoupling with the housing 201.

The foregoing description of the preferred embodiment of the invention has been presented for purposes of illustration and description. It is not intended to be exhaustive or to limit the invention to the precise forms disclosed, because many modifications or variations thereof are possible in light of the above teaching. All such modifications and variations are within the scope of the invention. The embodiments described herein were chosen and described in order to best explain the principles of the invention and its practical application, thereby to enable others skilled in the art to utilise the invention in various embodiments and with various modifications as are suited to the particular use contemplated thereof. It is intended that the scope of the invention be defined by the claims appended hereto, when interpreted in accordance with the full breadth to which they are legally and equitably suited.

The invention claimed is:

1. An electrical connector comprising:

an insulative housing that has a top, a bottom, a first side, a second side, all four sides connected to form a mating face and a board-mounting end;

a plurality of terminals supported in the housing and terminating at the board-mounting end wherein each terminal further comprises a contact portion configured to establish electrical contact with a complementary mating connector, a solder tail that extends out of the housing at the board-mounting end, a body portion that is disposed intermediate the contact portion and the solder tail and which interconnect them together;

a plurality of solder tabs engaged with the housing; and a plurality of engagement portions coupled to the housing to confine the solder tabs to a predetermined position with respect to the housing, wherein the engagement portion forms a sleeve with the housing comprising a top portion and a bottom portion.

2. The electrical connector of claim 1 wherein a major portion of the solder tabs is positioned behind the mating face.

3. The electrical connector of claim 1 wherein the engagement portion further comprises a vertical portion connecting the top portion to the bottom portion to form a general 'C' shape.

4. The electrical connector of claim 1 wherein the top portion and bottom portion each has a step at the side contiguous to the side of the housing thereby creating a insertion slot between the engagement portion and the side of the housing.

5. An electrical connector comprising:

an insulative housing that has a top, a bottom, a first side, a second side, all four sides connected to form a mating face and a board-mounting end;

a plurality of terminals supported in the housing and terminating at the board-mounting end wherein each terminal further comprises a contact portion configured to establish electrical contact with a complementary mating connector, a solder tail that extends out of the housing at the board-mounting end, a body portion that is disposed intermediate the contact portion and the solder tail and which interconnect them together;

a plurality of solder tabs engaged with the housing; and a plurality of engagement portions coupled to the housing to confine the solder tabs to a predetermined position with respect to the housing, wherein there is at least one solder tab coupled to at least one side of the housing, each solder tab further comprises a solder contact portion, an interconnect portion and a structure support portion bridging the solder contact portion and the interconnect portion together, optionally wherein the solder contact portion is stamped as part of the structure support portion and extends from the side of the housing.

6. The electrical connector of claim 5 wherein the interconnect portion further comprises a first edge, a second edge, a first face, a second face connected to form a distal end and wherein the first edge, the second edge, the first face and the second face taper towards the distal end.

7. The electrical connector of claim 5 wherein the interconnect portion further comprises a plurality of indentations along at least one edge of the interconnect portion, optionally further comprising a locking device to prevent the accidental disengagement of the solder tab from the connector.

8. The electrical connector of claim 7 wherein the locking device comprises a resilient side locking latch extending inwards from the first face to the second face of the interconnect portion, optionally wherein the housing further comprises a recess in the side of the housing contiguous to the engagement portion configured to engage the locking device.

9. The electrical connector of claim 5 wherein a major portion of the solder tabs is positioned behind the mating face.

10. The electrical connector of claim 5 wherein the engagement portion forms a sleeve with the housing comprising a top portion and a bottom portion.

11. The electrical connector of claim 10 wherein the engagement portion further comprises a vertical portion connecting the top portion to the bottom portion to form a general 'C' shape.

12. The electrical connector of claim 10 wherein the top portion and bottom portion each has a step at the side contiguous to the side of the housing thereby creating a insertion slot between the engagement portion and the side of the housing.

13. An electrical connector comprising:

an insulative housing that has a top, a bottom, a first side, a second side, all four sides connected to form a mating face and a board-mounting end wherein at the mating face, there is at least one mating slot extending into the housing;

a plurality of terminals supported in the housing and terminating at the board-mounting end wherein the terminals are grouped into a first set and a second set and each terminal in the first set and the second set further comprises a contact portion that extends into the mating slot, a solder tail that extends out of the housing at the board-mounting end, a body portion that is disposed intermediate the contact portion and the solder tail and which interconnect them together;

a plurality of solder tabs engaged with the housing; and a plurality of engagement portions coupled to the housing to confine the solder tabs to a predetermined position with respect to the housing, wherein the engagement portion forms a sleeve with the housing comprising a top portion and a bottom portion.

* * * * *